United States Patent [19]

Holl

[11] Patent Number: 4,476,794

[45] Date of Patent: Oct. 16, 1984

[54] NEEDLE CLAMP ARRANGEMENT FOR A SEWING MACHINE

[75] Inventor: Helmar Holl, Karlsruhe-Durlach, Fed. Rep. of Germany

[73] Assignee: Dorina Nahmaschinen GmbH, Fed. Rep. of Germany

[21] Appl. No.: 494,398

[22] Filed: May 13, 1983

[30] Foreign Application Priority Data

Sep. 4, 1982 [DE] Fed. Rep. of Germany ... 8224945[U]

[51] Int. Cl.[3] ..... D05B 55/02

[52] U.S. Cl. ..... 112/226; 112/302

[58] Field of Search ..... 112/226, 302

[56] References Cited

U.S. PATENT DOCUMENTS

| | | | |
|---|---|---|---|
| 278,857 | 6/1883 | Berwick | 112/226 |
| 2,691,951 | 10/1954 | Hansen | 112/226 X |
| 3,587,498 | 6/1971 | Weisz | 112/226 |
| 3,658,022 | 4/1972 | Roger | 112/226 |

*Primary Examiner*—Werner H. Schroeder
*Assistant Examiner*—Andrew M. Falik
*Attorney, Agent, or Firm*—McGlew and Tuttle

[57] ABSTRACT

A device for holding a sewing needle which has a cylindrical shank, an arcuate portion, and a flat wall portion, in a needle bar which has a longitudinally extending receiving groove with a flat interior receiving wall comprising a locking member. The locking member has a longitudinally extending bridge part with outwardly extending arms engageable around at least a portion of the circumference of the needle bar. The arms include an upper abutment arm extending outwardly of said bridge portion into the needle bar groove and defining a stop against which the top of the needle bar is engageable. The construction includes a lower abutment arm extending outwardly from the bridge engageable with an arcuate end over the arcuate portion of the shank so as to hold the flat portion of the shank of the needle on the flat interior receiving wall of the groove.

6 Claims, 4 Drawing Figures

NEEDLE CLAMP ARRANGEMENT FOR A SEWING MACHINE

FIELD AND BACKGROUND OF THE INVENTION

This invention relates in general to sewing machines and in particular to a new and useful needle holder for a sewing machine which comprises a device for locking a needle shank in a groove of a needle bar.

With the needle holder arrangements known until now there are difficulties in satisfactorily positioning the shank of the needle both in its height position and in its angular position. Usually several additional elements are necessary for this purpose, owing to which, besides expensive manufacture, further assembly costs arise.

SUMMARY OF THE INVENTION

To eliminate these disadvantages, the invention provides means for positioning the needle which are of uncomplicated design and easy to connect with the needle bar.

In accordance with the invention a needle which has a cylindrical shank portion, a flattened edge which engages against a flattened interior wall of a longitudinal groove in the needle bar is accurately positioned within the groove by means of a locking device which includes a bridge having an upper and lower arm disc portion which engages around the periphy of the cylindrical needle bar and includes an upper arm having an abutment which extends into the groove of the needle bar and forms an upper stop against which the needle is positioned and an arm spaced downwardly from this arm which has a contoured or cylindrically face which engages around the arcuate surface of the needle bar and presses the needle bar so that the flat face will be against the wall.

The device of the invention provides a locking element which may be used both for determining the height position of the needle relative to the bar as well as accurately oriented needle shank into the groove of the needle bar. The inventive arrangement of formed stable configuration and a secure attachment to the needle bar are achieved. The device for clamping the needle also includes a thread guide which is engaged with a bridge portion of the device and provides means for guiding the thread.

Accordingly it is an object of the invention to provide an improved locking device for locking a needle in a receiving groove of a needle bar.

A further object of the invention is to provide a device for positioning a needle shank in respect to a needle bar of a sewing machine which is simple in design, rugged in construction and economical to manufacture.

The various features of novelty which characterize the invention are pointed out with particularity in the claims annexed to and forming a pair of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 1:
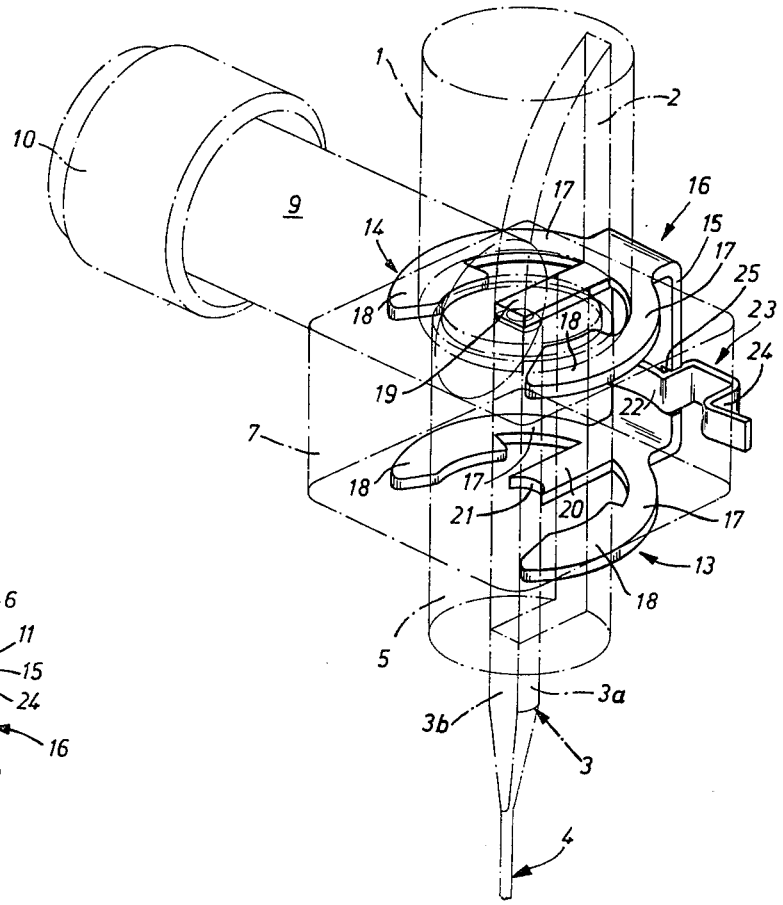
FIG. 1 is a perspective view of the lower end of a needle bar having a needle bar holder constructed in accordance with the invention.

Referring to the drawing in particular the invention embodied therein comprises a device in the form of lock generally designated 16 for holding a sewing needle 4 which has a shank 3 with an arcuate portion 3a and a flat wall portion 3b in a longitudinal groove 2 of a needle bar 1 so that the flat side 3b engages against the flat interior wall of the groove and is positioned at a desirable location. In accordance with the invention, the locking device comprises a longitudinally extending bridge part 15 having arm means in the form of discs 18 of an upper arm 14 and a lower arm 13 which engage around a substantial portion circularly cylindrical needle bar 1. The device 16 includes an upper abutment arm 19 which projects outwardly from the bridge portion and engages into the groove 2. The upper arm 19 describes a stop or abutment for the top of the needle shank portion 3. Another arm 20 formed with a cylindrical concave exterior surface 21 which engages against the arcuate surface 3a of the needle ensures that the flat surface 3b will be oriented against the flat interior wall of the longitudinal groove 2.

Figure 3:
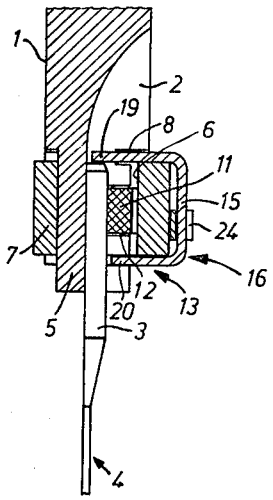
FIG. 3 is a section taken along the line III—III of FIG. 2.
Figure 2:
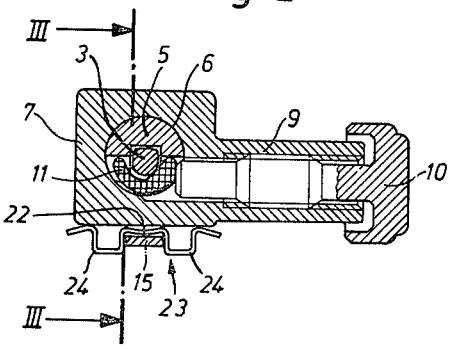
FIG. 2 is a transfer section through a needle bar and needle having a locking device constructed in accordance with the invention.

As FIGS. 1 to 3 show, there is cut into the lower end of a needle bar 1 a longitudinal groove 2 which extends from a certain point of the needle bar 1 to its lower end. This longitudinal groove 2 serves to receive a shank 3 of a needle 4. Shank 3 is flattened on one side, so that the needle 4 can be inserted in its correct angular position also be an unskilled operator.

At its lower end the needle bar 1 has a section 5 of smaller diameter. Onto this section 5, a needleblock 7 with a bore 6, is press-fitted in such a way that there results an annular transverse groove 8 between the upper end face of the needle block 7 and the portion of the needle bar 1 with normal diameter.

The needle block 7 has a laterally extending tubular projection 9 with female thread for the threadable engagement of a clamping screw 10. The screw is pressed by its end against a clamping piece 1 lying in a recess 2 which passes through the needle bar 1.

The locking element 16 consisting of two parallel annular discs 13 and 14 and the bridge piece 15 can be slipped onto the section 5 of the needle bar 1 over the needle block 7. The discs 13 and 14 comprise sprung arcuate arms 17, which are provided at their ends with inwardly directed lobes 18, the inner faces of which apply against the circumference of section 5. When being slipped onto section 5, the arms 17 of the upper disc 14 insert themselves additionally into the transverse groove 8.

The upper disc 14 is further equipped with a flat abutment 19 which extends crosswise into the longitudinal groove 2 and forms a stop for shank 3 of needle 4 upon insertion in the longitudinal groove 2. The lower disc 13 is provided with the arm 20 which likewise extends into the longitudinal groove 2. The free end of this arm 20 has a contour area 21 adapted to the diameter of shank 3 of needle 4, which contour area together with the inner wall of the longitudinal groove 2 leaves a free passage adapted to the cross section of shank 3. Therefore, shank 3 of needle 4 is insertable into the longitudinal groove 2 only in the predetermined angular position.

The bridge piece 15 of the locking element 16 is, after the latter has been slipped onto the needle bar 1, spaced from the front of the needle block 7 in order to leave space for a cross piece 22 of a thread guiding element 23. The thread guiding element 23 serves to receive a needle thread or two needle threads, one of which can then be threaded into right or left eyelet 24. The eyelets 24 are formed symmetrically on the cross piece 22. Their free ends apply against the needle block 7, while the ends connected with the cross piece 19 lie in a retention formed by lateral recesses 25 of bridge piece 15.

Figure 4:
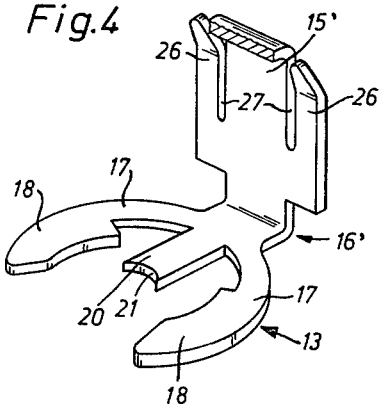
FIG. 4 is a front perspective view partly in section of another embodiment of locking device.

In FIG. 4, is shown a locking element 16' which comprises a bridge piece 15' equipped with enlargements 26. The enlargements are separated upwardly from the bridge piece 15' by thread guiding slots 27. Here the needle threads are threaded simply into the slots 27.

When inserting shank 3 of needle 4 into the longitudinal groove 2 of needle bar 1, shank 3 is inserted against abutment 19 in an angular position such that the flattened area at shank 3 applies against the inner wall of the longitudinal groove 2. The contour area 21 of arm 20 prevents the needle 4 from being inserted in a wrong angular position. The clamping screw 10, when being screwed in, presses against the clamping piece 11, owing to which the latter locks between bore 6 in needle block 7 and shank 3 of the needle 4. Shank 3 is pressed against the inner wall of the longitudinal groove 2 and thus needle 4 is fixed in its position.

While a specific embodiment of the invention has been shown and described in detail to illustrate the application of the principles of the invention, it will be understood that the invention may be embodied otherwise without departing from such principles.

What is claimed is:

1. A device for holding a sewing needle which has a shank with an arcuate portion and a flat wall portion received in a cylindrical needle bar which has a longitudinally extending receiving groove in a flat interior receiving wall at the inside of the groove, comprising a locking member having a longitudinally extending bridge part, arm means carried by said bridge part and extending around at least a portion of the circumference of said needle bar, an upper arm carried by said bridge part and extending outwardly from said bridge part into the groove and defining a stop for the top of the needle shank, and a lower abutment arm extending outwardly from said bridge portion having an outer edge of arcuate shape which engages around the arcuate portion of said needle shank and acts to position the flat wall of the shank against the flat wall of said groove.

2. A device according to claim 1, wherein said locking device comprises upper and lower vertically spaced disc portions connected to said bridge part comprising said arm means, one of said discs having said upper arm forming an abutment for said needle shank and the other of said disc having an abutment arm with an arcuate end face engageable with said needle shank.

3. A device according to claim 2, wherein said disc has arcuate interior wall portions engageable against the periphery of said needle bar.

4. A device according to claim 1, including a thread guide member connected to said bridge part and forming a guide for thread.

5. A device according to claim 1, including a thread guide member having an intermediate part engaged between said bridge portion and the needle bar having U shaped portions which engage against the side of said device and form with said device thread guiding holes for the passage of thread.

6. A device according to claim 1, including a block member engaged over said needle bar extending around said needle, a clamping piece disposed between said needle and said block member, a tubular projection threaded into said block member and bearing against said clamping piece, distorts said piece into engagement with said needle shank and to hold said needle shank in the groove of said needle bar.

* * * * *